US007146649B2

(12) United States Patent
Kronenbeger

(10) Patent No.: US 7,146,649 B2
(45) Date of Patent: Dec. 12, 2006

(54) ORNAMENTATION FOR APPAREL ARTICLE

(76) Inventor: Ronald Kronenbeger, 320 Portwine Rd., Riverwoods, IL (US) 60015

( * ) Notice: Subject to any disclaimer, the term of this patent is extended or adjusted under 35 U.S.C. 154(b) by 0 days.

(21) Appl. No.: 11/013,026

(22) Filed: Dec. 15, 2004

(65) Prior Publication Data

US 2006/0143789 A1 Jul. 6, 2006

(51) Int. Cl.
*A42B 1/00* (2006.01)

(52) U.S. Cl. ..... 2/195.1; 2/209.13

(58) Field of Classification Search ..... 2/195.1, 2/184, 171

See application file for complete search history.

(56) References Cited

U.S. PATENT DOCUMENTS 2,088,455 A * 7/1937 Witt ..... 28/150
2,523,130 A * 9/1950 Victor ..... 2/144
2,772,698 A * 12/1956 Linehan, Jr. ..... 139/384 R
2,799,956 A * 7/1957 Ciroli ..... 223/46
4,774,728 A * 10/1988 Carnicella ..... 2/243.1
4,776,043 A * 10/1988 Coleman ..... 2/209.12
5,086,516 A * 2/1992 Baxter et al. ..... 2/108
5,359,734 A * 11/1994 Rathburn ..... 2/195.1
5,817,393 A 10/1998 Stahl
5,974,997 A * 11/1999 Amburgey ..... 112/475.01
6,675,512 B1 * 1/2004 Shwartz et al. ..... 40/329

OTHER PUBLICATIONS www.usscouts.org/profbvr/firecrafter/events.html.*
www.foothill.edu/police/insignia.html.*

* cited by examiner

*Primary Examiner*—Gary L. Welch
*Assistant Examiner*—Richale L. Haney
(74) *Attorney, Agent, or Firm*—Wood, Phillips, Katz, Clark & Mortimer

(57) ABSTRACT

A headwear piece defining an opening for receiving a wearer's head with the headwear piece in an operative position on the wearer's head. The crown has an exposed surface. Ornamentation is applied to the exposed surface of the crown. The ornamentation has a substrate layer, that is separate from and secured to the exposed surface of the crown, and a design piece separately formed from and attached to the substrate layer. The design piece has thread that is formed to produce at least a part of a viewable design.

19 Claims, 2 Drawing Sheets

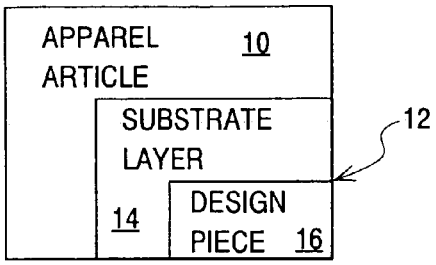
Fig. 1
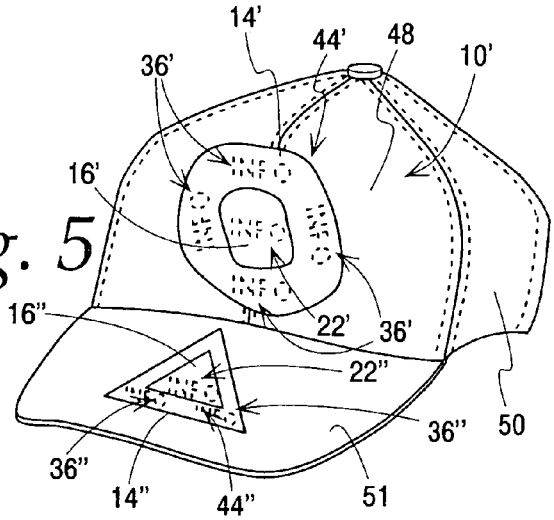
Fig. 5
Fig. 3
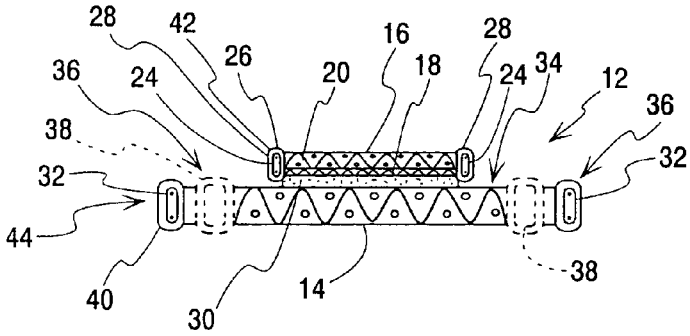
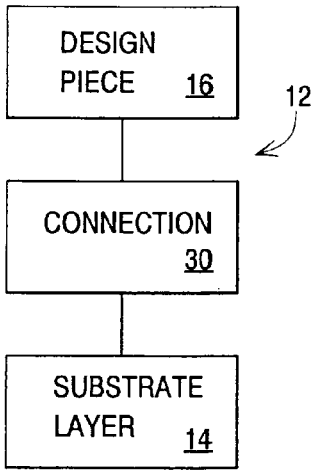
Fig. 4
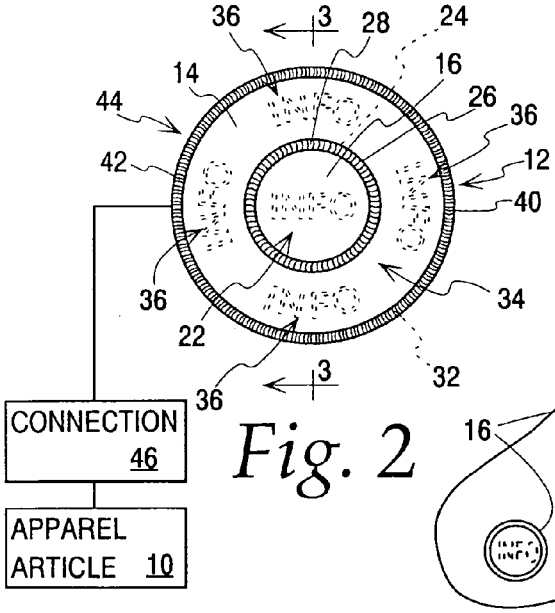
Fig. 2
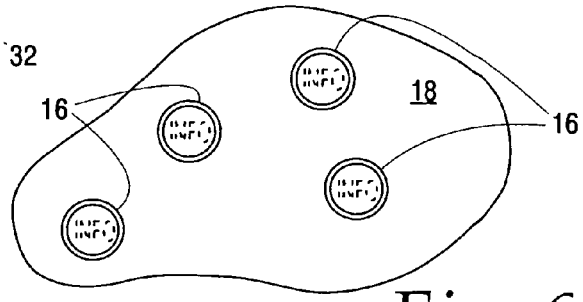
Fig. 6

ORNAMENTATION FOR APPAREL ARTICLE

BACKGROUND OF THE INVENTION

1. Field of the Invention

This invention relates to apparel and, more particularly, to ornamentation that can be placed thereon for purposes of aesthetics and/or to convey information.

2. Background Art

Many different apparel articles, such as headwear, shirts, jackets, purses, etc. have ornamentation thereon that enhances the appearance thereof and/or conveys information, such as the identity of: a) a person, place, or thing; b) an event; c) competitors in an event, etc. For purposes of explanation herein, the focus will be on ornamentation applied to headwear, with it being understood that the ornamentation can be similarly applied to any other apparel article.

Headwear, and more specifically baseball-style caps, to include baseball caps, visors, etc., is commonly adorned by applications to external surfaces of a crown, which accommodates a wearer's head. Numerous different techniques are utilized to apply this ornamentation.

As one example, thread may be embroidered directly against the crown. Since it is common to make the basic headwear piece before the application of ornamentation, this procedure has a number of drawbacks. First of all, the embroidery process is carried out on a curved surface. This introduces problems both in terms of handling the headwear piece during the embroidery operations and aligning the stitching material with the curved surface. Improper coordination between the headwear piece and embroidery machinery may produce a less than desired quality of product.

As an alternative to directly embroidering on the crown, or an associated brim/bill, it is known to pre-form patches in a flattened state and thereafter apply the same to the headwear piece. A typical patch may consist of a substrate layer to which thread is applied through weaving or embroidery operations.

Modern techniques for producing woven labels permit relatively fine and precise detail to be integrated into the patch. However, inherently, the processes to produce patches through weaving are more time consuming, and, thus more expensive than those used to embroider. Consequently, woven patches are generally made relatively small in size for use on mass-produced headwear. While woven patches are desirable from an aesthetic standpoint, they are often opted away from in favor of embroidered patches which, in the same price range, can be made larger to be more dominant and eye catching. The above problems are common to weaving operations that are performed directly upon the crown as well as those which employ a separate substrate layer to produce a patch that is subsequently applied to the headwear.

Consequently, the industry has maintained different categories of product. Headwear with ornamentation applied through weaving operations has generally been in the high-end category and such that the ornamentation is more discrete in appearance. Ornamentation applied through conventional embroidery procedures offers more opportunity to be applied over a substantial areal extent, while maintaining cost at a relatively low level. The latter result is achieved at the expense of clarity, definition, and detail of the subject matter formed on the headwear, either directly or through separately applied patches.

Those in the headwear industry compete often based on the quality of the ornamentation. Designers must balance the quality of the ornamentation versus the price that the consumer is willing to pay for such products.

SUMMARY OF THE INVENTION

In one form, the invention is directed to a headwear piece defining an opening for receiving a wearer's head with the headwear piece in an operative position on the wearer's head. The crown has an exposed surface. Ornamentation is applied to the exposed surface of the crown. The ornamentation has a substrate layer, that is separate from and secured to the exposed surface of the crown, and a design piece separately formed from and attached to the substrate layer. The design piece has thread/yarn that is formed to produce at least a part of a viewable design.

In one form, yarn is woven to produce the at least part of the viewable design.

The viewable design may have first information thereon related to a first subject matter and second information related to the first subject matter applied to the substrate layer around the design piece.

In one form, the design piece has a perimeter shape, the substrate layer has a perimeter shape, and the perimeter shape of the substrate layer corresponds to the perimeter shape of the design piece.

In one form the perimeter shapes are substantially round.

The second information may be formed in a curved shape around the design piece. In one form, the second information is at least one of letters and numbers.

The first information may include a logo related to the first subject matter.

In one form, the design piece has a border line with a first shape and the substrate layer has a surrounding line corresponding in shape to the border line on the design piece.

In one form, the border and surrounding lines define concentric circles.

The border and surrounding lines may be defined by thread defining projecting beads.

The design piece may include a second substrate layer on which thread is formed.

The second information may be applied to the substrate layer using thread.

The invention is further directed to an apparel article having a sheet layer defining an exposed surface and ornamentation applied to the exposed surface. The ornamentation has a substrate layer, that is separately formed from and secured to the exposed surface of the sheet layer, and a design piece separately formed from and attached to the substrate layer. The design piece has thread/yarn that is formed to produce at least a part of a viewable design.

In one form, the at least part of the viewable design has first information related to a first subject matter and second information related to the first subject matter applied to the substrate layer around the design piece.

The second information may be applied to the substrate layer using thread.

The invention is further directed to a method of producing ornamentation for an apparel article. The method includes the steps of: providing a first substrate layer; forming a design piece by applying thread/yarn to the first substrate layer in a manner so as to produce at least a part of a viewable design; providing a second substrate layer; applying the design piece to the second substrate layer to produce a patch; and applying the patch to an exposed surface of an apparel article.

In one form, the viewable design includes first information. The method may further include the step of applying thread to the second substrate layer around the design piece to produce second information that relates to the first information.

The first information may include a logo. The step of applying thread to produce second information may involve applying thread that produces second information that consists of at least one of letters and numbers.

The method may further include the steps of providing a continuous border line around the design piece and a continuous surrounding line on the substrate layer such that the continuous border and surrounding lines have corresponding shapes, one within the other.

The method may further include the steps of applying first and second design pieces to the second substrate layer and cutting the second substrate layer to produce first and second patches each having one of the design pieces.

The method may further include the steps of applying thread to the second substrate layer to produce information around the first and second design pieces that is different on the first and second patches.

BRIEF DESCRIPTION OF THE DRAWINGS

FIG. 1 is a schematic representation of an apparel article with ornamentation according to the present invention th/ereon, and consisting of a substrate layer with an attached design piece that define a patch;

FIG. 2 is an elevation view of the inventive ornamentation in FIG. 1 in the form of a circular patch;

FIG. 3 is a cross-sectional view of the ornamentation taken along lines 3—3 of FIG. 2;

FIG. 4 is a schematic representation of the ornamentation in FIGS. 1–3 and showing a generic connection between the design piece and substrate layer;

FIG. 5 is a perspective view of a headwear piece, representative of the apparel article in FIG. 1, and with ornamentation according to the invention in two different forms attached to the crown and brim/bill;

FIG. 6 is a plan view of a substrate layer upon which a plurality of design pieces are formed;

DETAILED DESCRIPTION OF THE DRAWINGS

Figure 7:
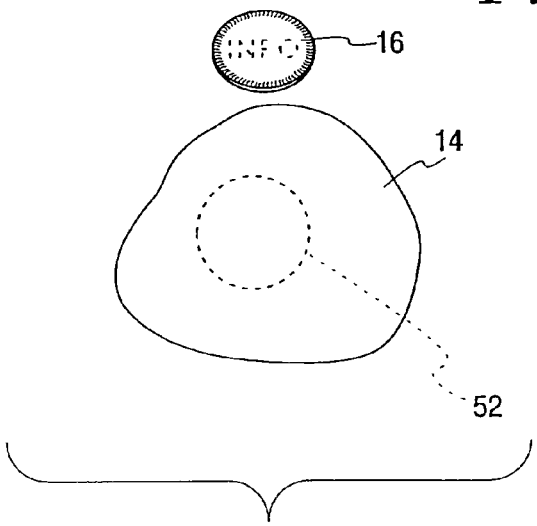
FIG. 7 is an exploded perspective view of a substrate layer to which the inventive design piece is attached.

In FIG. 1, an apparel article, according to the present invention, as shown in 10. The apparel article 10 is shown in a schematic form intended to encompass every conceivable apparel article, such as, but not limited to, hats, shirts, coats, pants, ties, shoes and socks, and accessories, such as purses, headbands, etc. Generally, the apparel article 10 has a sheet layer, to which ornamentation 12 according to the present invention is applied.

One form of the ornamentation 12 is shown in FIGS. 2 and 3. The ornamentation consists of a substrate layer 14 to which a design piece 16 is attached. In a preferred form, the design piece 16 is separately formed from the substrate layer 14. The design piece 16 has a separate substrate layer 18 upon which woven yarn 20 is applied to produce a viewable design, as shown at 22 in FIG. 2. The viewable design 22 is identified as "info",intended to generically encompass virtually a limitless number of different designs. For example, the design may be in the nature of a picture, a logo, words, numbers, etc. Regardless of the nature of the design, it is intended that the design conveys some sort of information, either directly or indirectly related to a particular subject matter.

The design piece 16 has a perimeter shape bounded by an edge 24. In this embodiment, thread 26 is wrapped around the perimeter edge 24 to produce a raised bead that defines a border line 28. The substrate layer 14 may be any sheet layer, such as one made from fabric, plastic, leather, etc. As shown in FIG. 4, the design piece 16 is attached to the substrate layer 14 through an appropriate connection 30, which may be stitching, an adhesive, or other means known to those skilled in the art. In the exemplary embodiment shown in FIGS. 2 and 3, an adhesive layer 30 is shown for the connection.

The substrate layer 14 has a perimeter edge 32 that is spaced uniformly from the perimeter edge 24 of the design piece 16, in this embodiment, fully around the design piece 16. This produces an exposed, annular surface area 34 around the design piece 16 upon which additional information, shown generically at 36, can be applied. In this embodiment thread 38 is used to define the information 36. Again, the nature of the information 36 is not limited in any manner.

A separate thread 40 is stitched around the perimeter edge 32 to define a raised bead 42 which defines a surrounding line. The bead/surrounding line 42 might alternatively be spaced inwardly from the peripheral edge 32. The information 36 is shown applied in a curved shape corresponding to that between the lines 28, 42.

The combined design piece 16 and substrate layer 14 define a patch at 44 that can be applied to an exposed surface of the apparel article 10 through an appropriate connection 46. The connection 46 may be in the form of thread, an adhesive, or other means, known to those skilled in this art, which facilitates attachment to the apparel article 10.

In a preferred form, the viewable design 22 on the design piece 16 is formed by weaving the yarn 20. This permits high quality, detailed information to be formed for the viewable design 22. However, a virtually unlimited number of other methods of forming this information are contemplated. As one example, the information 22 may be in the nature of a logo, a picture, representative of a place, location or event, etc. The information 36 preferably relates to the subject matter of the information 22. Thread 38 defining the information 36 may be applied as by using conventional embroidery techniques, or by any other means known to those skilled in this art.

As examples of the coordination between the information 22, 36, the information 22 may be a team logo. The information 36 may be a word identification associated with that team. As a further example, the information 22 may relate to an event or an organization, with the information 36 more specifically describing something associated with that organization or event. The information 22 might be a logo for a particular golf venue, with the information 36 identifying a tournament that is played a particular year. Alternatively, the information 22 may identify a competition, with the information 36 identifying an aspect of the competition, which may be its location, the entities competing, etc.

In this embodiment, the perimeter shapes of the design piece 16 and substrate layer 14 correspond and are round. The border line 28 and surrounding line 42 are circular and concentric. It is not necessary, however, that the peripheral shapes of the design piece 16 and substrate layer 14 be corresponding, or that they be circular in shape. The circular shape is selected for its aesthetic appeal.

In FIG. 5, an exemplary apparel article 10' in the form of headwear piece is shown with a patch 44' applied to an exposed surface 48 of a crown 50. The patch 44' consists of a substrate layer 14' to which a design piece 16' is applied. The design piece 16' has information 22' thereon, with the surrounding substrate layer 14 having information 36' thereon. In this embodiment, the substrate layer 14 has a random shape, with the design piece 16' having a non-corresponding shape.

As a further alternative, as shown in FIG. 5, a patch 44" is shown applied to a brim/bill 51 with a substrate layer 14" having a triangular shape, with the design piece 16" having a corresponding shape and applied thereto. The design piece 16" has information 22" applied thereto, with the substrate layer 14" having information 36" applied thereto.

The ornamentation 12 lends itself to being manufactured in a number of different ways. As shown in FIG. 6, the substrate layer 18 may be defined as a sheet with an area that is substantially greater than that of the design piece 16. The design piece 16 may be formed on the substrate layer 18 and subsequently cut therefrom.

The design piece 16 can then be combined with the substrate layer 14 in any of a number of different ways. Three exemplary ways are shown in FIGS. 7–9.

In FIG. 7, a continuous sheet of the substrate layer 14 is provided to which the design piece 16 is applied. Thereafter, the substrate layer 14 is cut, as at the line 52, to product the desired overall shape for the resulting patch 44.

Figure 8:
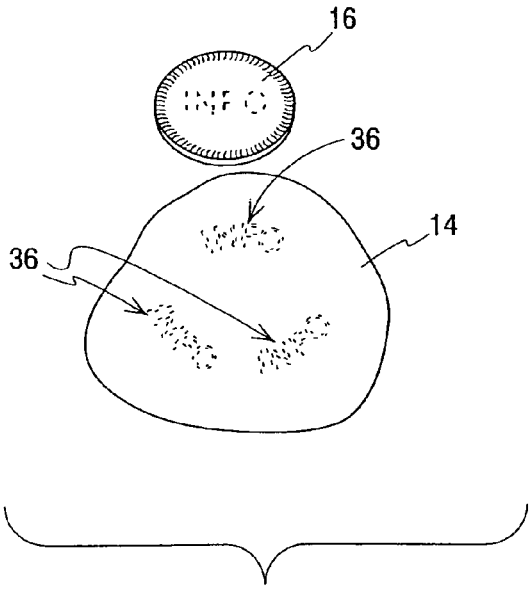
FIG. 8 is a view as in FIG. 7 wherein information is applied to the substrate layer before the design piece is attached thereto.

In FIG. 8, the information 36 is applied to the substrate layer 14 with the substrate layer 14 in continuous sheet form. The substrate layer 14 can then be cut to produce the desired outline for the patch.

Figure 9:
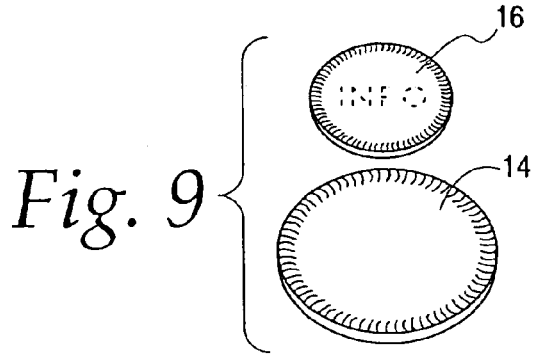
FIG. 9 is a view as in FIGS. 7 and 8 wherein the substrate layer is cut to an end size before the design piece is attached thereto.

As a further alternative, as shown in FIG. 9, the substrate layer 14 is pre-cut to the desired end patch shape, after which the design piece 16 is applied. The information 36 may be applied to the substrate layer 14 before or after application of the design piece 16.

Other variations of these methods are contemplated.

Figure 10:
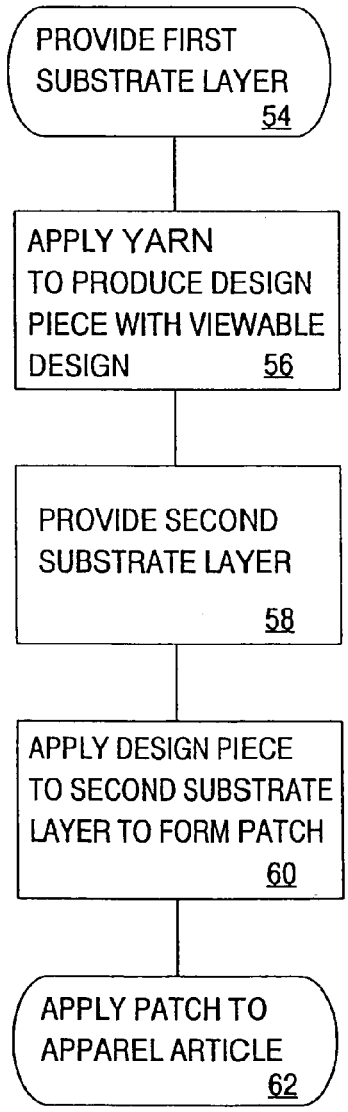
FIG. 10 is a flow diagram representation of a method of producing ornamentation for an apparel article, according to the invention.

A generic form of method for producing ornamentation on an apparel article is shown in FIG. 10 in flow diagram form. As shown at block 54, a first substrate layer is provided. As shown in block 56, yarn is applied over the first substrate layer to produce a design piece with a viewable design. A second substrate layer is provided as shown at block 58. The design piece is applied to the second substrate layer to form a patch, shown at block 60. As shown at block 62, the patch is applied to the apparel article.

It is also contemplated that each patch 44 could be attached to an apparel article 10 in a manner to be separable therefrom, as described in co-pending U.S. application Ser. No. 10/726,877, entitled "Method of Adorning an Article and an Adorned Article Made Using the Method", which is incorporated herein by reference. To accomplish this, the connection 46 may be effected by spot stitching or virtually any other type of stitches that allows the thread to be cut to separate the patch 44. The patch 44 can be replaced with another patch at the same or different location on an apparel article. This allows the method in application Ser. No. 10/726,877 to be practiced, whereby customers can remove and replace ornamentation as dictated by an event, or otherwise by a particular demand.

The foregoing disclosure of specific embodiments is intended to be illustrative of the broad concepts comprehended by the invention.

The invention claimed is:

1. A headwear piece comprising:

a crown defining an opening for receiving a wearer's head with the headwear piece in an operative position on the wearer's head, the crown having an exposed surface; and ornamentation applied to the exposed surface of the crown, the ornamentation comprising a substrate layer, that is separate from and secured to the exposed surface of the crown, and a design piece separately formed from and attached to the substrate layer, the design piece comprising yarn that is woven to produce a viewable design, wherein the viewable design comprises first information that is one of: a) a logo; b) a picture; c) representative of a place, location or event; d) related to a team or organization; e) a word; and f) a number, wherein the substrate layer is exposed to view in conjunction with the viewable design with the ornamentation applied to the exposed surface of the crown, wherein the first information is related to a first subject matter and second information related to the first subject matter is applied to the substrate layer around the design piece, wherein the second information is applied in a manner other than by using woven yarn.

2. The headwear piece according to claim 1 wherein the design piece has a perimeter shape and the substrate layer has a perimeter shape corresponding to the perimeter shape of the design piece.

3. The headwear piece according to claim 2 wherein the perimeter shapes are substantially round.

4. The headwear piece according to claim 1 wherein the second information is formed in a curved shape around the design piece.

5. The headwear piece according to claim 4 where the second information comprises at least one of letters and numbers.

6. The headwear piece according to claim 1 wherein the first information comprises a logo related to the first subject matter.

7. The headwear piece according to claim 6 wherein the design piece has a border line with a first shape and the substrate layer has a surrounding line corresponding in shape to the border line on the design piece.

8. The headwear piece according to claim 7 wherein the border and surrounding lines define concentric circles.

9. The headwear piece according to claim 7 wherein the border and surrounding lines are defined by thread defining projecting beads.

10. The headwear piece according to claim 1 wherein the design piece comprises a second substrate layer on which thread is formed.

11. The headwear piece according to claim 1 wherein the second information is applied to the substrate layer using thread.

12. An apparel article comprising:

a sheet layer defining an exposed surface; and ornamentation applied to the exposed surface, the ornamentation comprising a substrate layer, that is separately formed from and non-releasably secured to the exposed surface of the sheet layer, and a design piece separately formed from and attached to the substrate layer so that the substrate layer is exposed to view in conjunction with the viewable design with the ornamentation applied to the exposed surface of the crown, the design piece comprising yarn that is woven to produce a viewable design comprising first information that is one of: a) a logo; b) a picture; c) representative of a place, location or event; d) related to a team or organization; e) a word; and f) a number, wherein the first information is related to a first subject matter and second information related to the first subject matter is applied to the substrate layer around the design piece.

wherein the second information is applied in a manner other than by using woven yarn.

13. The apparel article according to claim 12 wherein the second information is applied to the substrate layer using thread.

14. A method of producing ornamentation for an apparel article, the method comprising the steps of:

providing a first substrate layer;

weaving yarn on the first substrate layer in a manner so as to produce a viewable design comprising first information and thereby forming a design piece, wherein the first information thereon is one of: a) a logo; b) a picture; c) representative of a place, location or event; d) related to a team or organization; e) a word; and f) a number and related to a first subject matter;

providing a second substrate layer;

non-releasably applying the formed design piece to the second substrate layer to produce a patch so that the second substrate layer is exposed to view in conjunction with the viewable design with the design piece applied to the second substrate layer;

applying second information related to the first subject matter to the second substrate layer around the design piece in a manner other than by using woven yarn; and non-releasably applying the patch to an exposed surface of an apparel article.

15. A method of producing ornamentation for an apparel article according to claim 14 wherein the step of applying second information comprises applying thread to the second substrate layer around the design piece to produce the second information.

16. The method of producing ornamentation for an apparel article according to claim 15 wherein the first information comprises a logo and the step of applying thread to produce second information comprises applying thread that produces second information that comprises at least one of letters and numbers.

17. The method of producing ornamentation for an apparel article according to claim 15 further comprising the steps of applying first and second design pieces on the second substrate layer and cutting the second substrate layer to produce first and second patches each having one of the design pieces.

18. The method of producing ornamentation for an apparel article according to claim 17 further comprising the steps of applying thread to the second substrate layer to produce information around the first and second design pieces that is different on the first and second patches.

19. The method of producing ornamentation for an apparel article according to claim 14 further comprising the steps of providing a continuous border line around the design piece and a continuous surrounding line on the substrate layer piece such that the continuous border and surrounding lines have corresponding shapes, one with the other.

* * * * *